United States Patent [19]

Provence

[11] Patent Number: 4,941,675

[45] Date of Patent: Jul. 17, 1990

[54] CROSS COUNTRY SKI LINKAGE APPARATUS INCLUDING PRE-STRESSED BLADE

[75] Inventor: Marc Provence, Annecy, France

[73] Assignee: Salomon S.A., Annecy, France

[21] Appl. No.: 927,117

[22] Filed: Nov. 5, 1986

[30] Foreign Application Priority Data

Nov. 26, 1985 [FR] France ..... 85 17444

[51] Int. Cl.[5] ..... A63C 9/00

[52] U.S. Cl. ..... 280/615

[58] Field of Search ..... 280/614, 615, 631, 611

[56] References Cited

U.S. PATENT DOCUMENTS

| | | | |
|---|---|---|---|
| 4,365,821 | 12/1982 | Kreyenbuhl | 280/615 |
| 4,410,199 | 10/1983 | Eisenberg | 280/615 |
| 4,562,653 | 1/1986 | Salomon | 280/615 |
| 4,647,064 | 3/1987 | Salomon et al. | 280/615 |

FOREIGN PATENT DOCUMENTS

| | | |
|---|---|---|
| 0088673 | 9/1983 | European Pat. Off. . |
| 0602623 | 8/1934 | Fed. Rep. of Germany . |
| 2336152 | 7/1977 | France . |
| 2370488 | 6/1978 | France . |
| 2387062 | 11/1978 | France . |
| 2447731 | 8/1980 | France . |
| 2500312 | 8/1982 | France . |
| 2527932 | 12/1983 | France . |
| 2537011 | 6/1984 | France . |
| 84/00498 | 2/1984 | PCT Int'l Appl. . |
| 84/03225 | 8/1984 | PCT Int'l Appl. . |
| 0161590 | 5/1933 | Switzerland . |

*Primary Examiner*—Charles A. Marmor
*Assistant Examiner*—Richard Camby
*Attorney, Agent, or Firm*—Sandler, Greenblum & Bernstein

[57] ABSTRACT

A linkage apparatus between the end of a boot and a cross-country ski, includes a flexion blade adapted to be affixed to a ski by its anterior end and to receive the end of a ski boot or shoe at its posterior end has a lower surface which is fitted against an upper surface of a support plate attached to the ski or the ski itself. The lower surface of the blade and the upper side of the ski lie in planes which are non-complementary with respect to each other in a manner which creates during assembly of the boot to the ski a pre-stressed moment in the blade which tends to counteract the tendency of the rear portion of the blade to lift-off the ski when the material making up the blade becomes fatigued by maintaining the rear portion of the flexion blade pressed against the ski when the boot has been detached.

26 Claims, 4 Drawing Sheets

CROSS COUNTRY SKI LINKAGE APPARATUS INCLUDING PRE-STRESSED BLADE

BACKGROUND OF THE INVENTION

1. Field of the Invention

The present invention relates generally to linkage apparatus provided on cross country skis for the attachment of ski boots to the skis. More particularly, the present invention is directed to an improvement of linkage apparatus in which the linkage element is an elongate elastic element in the shape of a blade positioned to interconnect the ski and the boot which is provided with a pre-stressed moment when attached to the ski which counteracts the tendency of the elastic elongate element to lift off the ski in the absence of externally applied force.

2. Description of Background and Material Information

French Patent No. 2,447,731, commonly owned with the present application, describes a linkage apparatus in which the ski, or other support element, is provided with an upper horizontal surface adapted to receive an elastic blade, known as a flexion blade, which forms a connection between the ski and the tip of the boot. The anterior section of the flexion blade is fitted in a housing attached to the upper surface of the ski in a manner so as to be pressed against the upper surface of the support element. The posterior section of the flexion blade is free or otherwise unattached to the upper surface of the ski. The rear end of the flexion blade is adapted to receive, in a removable fashion, the front end of a boot or shoe by means of an appropriate boot insertion mechanism. Typical boot insertion mechanisms include an attachment ring, a pivotable lever and a support plate. In the course of use, the movements applied by the skier principally involve pivoting the boot with respect to the ski in a longitudinal vertical plane. Such action results with a corresponding flexing of the flexion blade generally around an axis extending transversely through a region of reduced thickness of the flexion blade in which the flexing preferably occurs. After a certain amount of use, however, it appears that the flexion blade exhibits a permanent deformation in its pivot or flexing zone of reduced thickness, due to the fatigue of the material from which it is formed, such that the posterior region of the blade, when the blade is at rest, rises away from the upper surface of the ski in a substantially lifted-off position.

This phenomenon is disadvantageous in that a space results between the flexion blade and the upper surface of the ski. This gap allows snow to become lodged between the upper surface of the ski and the lower surface of the flexion blade in this important region of the binding. The presence of snow or ice in this region of the binding can prevent the blade, and consequently the boot, from flattening against the ski to the discomfort and inconvenience of the skier during skiing.

Another disadvantage which stems from the deformation of the blade is more of a psychological concern than a practical problem. When a skier observes the permanent deformation of the flexion blade, as discussed above, the skier tends to associate the deformation of the blade with a deterioration of the linkage apparatus. Although the disadvantages relating to snow pose real problems from the standpoint of performance, the deformation of the blade does not adversely affect the durability of the binding apparatus nor is it indicative of deterioration of the flexion blade.

It has been observed that the previously discussed disadvantages occur with linkage apparatus in which the toe of the boot is fixed in a removable fashion at the posterior end of the flexion blade, as well as with linkage apparatus in which the flexion blade is integral with the toe area of the boot. In this latter case, however, the permanent deformation by fatigue of the flexion blade is less perceptible and problems caused by snow becoming packed between the blade and the upper surface of the support element while the boot and its integral flexion blade are disengaged from the ski do not occur.

SUMMARY OF THE INVENTION

An object of the present invention is to provide a linkage apparatus for connecting the end of a boot with a cross-country ski including a generally elongate elastic element for associating the upper side of a ski with an end of a boot to allow for a pivoting movement of the boot around a substantially horizontal axis which is transverse to the ski, adapted to have a pre-stressed moment when the elastic elongate element is associated with the ski whereby the tendency of the elastic element to lift off the the ski in the absence of force being applied to the elastic elongate element is counteracted by the pre-stressed moment.

Another object of the present invention is to provide a linkage apparatus, as described above, wherein the elongate elastic element includes an anterior portion having a front end and a forward lower surface area adapted to be connected to an upper surface associated with the ski, and a posterior portion having a rear end adapted to be attached to the boot and a rearward lower surface area adapted to contact the upper surface, with the forward lower surface area extending rearwardly from the front end, and the rearward lower surface area extending forwardly from the rear end to meet and form a lower surface of the elastic elongate element.

A further object of the present invention is the provision of a linkage apparatus, as described above, wherein the elastic elongate element has an upper surface and predetermined thickness between the upper surface and the lower surface, and is provided with a flexion zone intermediate the front end and the rear end of the elastic elongate element. The forward lower surface area and the rearward lower surface area preferably slope with respect to each other to meet within an area of intersection below the flexion zone, preferably wherein the slope is towards the upper surface so that the area of intersection defines a region of reduced thickness with the upper surface. The area of intersection is preferably V-shaped, and at least one of the forward lower surface area and the rearward lower surface area is planar. The area of intersection may include a curved section, and the lower surface of the elastic member may be generally concave, preferably wherein at least one of the forward lower surface area and the rearward lower surface area is planar, and the upper surface includes a transverse groove above the region of reduced thickness. The elongate elastic element is preferably in the form of a blade.

A still further object of the present invention is the provision of a linkage apparatus, as described above, which also includes means for securing the anterior portion of the elastic elongate element in position with respect to an upper surface associated with a ski which attached to the ski, preferably wherein the means for connecting includes means for compressing the anterior portion of the elongate elastic element, such as a housing having a dimension less than a corresponding dimension of the anterior portion, a screw passing through the anterior portion and anchored in the ski, or wherein the means for securing includes a support having lateral sides attached to the ski and means for pressing the anterior portion towards the ski pivotably connected to the support by a journal extending transversely between the lateral sides, in addition to means for pivoting the means for pressing pivotably connected to the support by a second journal extending transversely between the lateral sides, wherein the means for pivoting is a lever, and the means for pressing is a hook.

A yet still further object of the present invention is a linkage apparatus, as described above, which also includes a base plate including the upper side associated with the ski, and a bottom side adapted to be attached to the ski, wherein the lower surface of the elastic element has a longitudinal profile and the upper surface of the base plate has a longitudinal profile which are non-complimentary. The base plate preferably includes an anterior region having a front end and an anterior upper surface area adapted to be connected to the forward lower surface area of the elongate elastic element, and a posterior region having a rear end and a posterior upper surface area adapted to contact the rearward lower surface area of the elongate elastic means wherein the anterior upper surface area extends rearwardly from the front end and the posterior upper surface area extends forwardly from the rear end so as to meet and form the upper surface of the base plate. The anterior region is preferably wedge-shaped and the anterior upper surface area slopes downwardly from the front end to meet the posterior upper surface area at an intersection, which is generally V-shaped. At least one of the anterior upper surface area and the posterior upper surface area is planar, and the intersection preferably includes a curved section.

Another further object of the present invention is the provision of a linkage apparatus, as described above, wherein the forward lower surface area and the rearward lower surface area meet at a predetermined angle of intersection prior to the elastic elongate element being secured in position on the ski, and wherein the angle of intersection subsequent to the elastic elongate element being secured in position differs from the predetermined angle of intersection by an angle of deformation within the range of 5° and 45°, and preferably 20°. The force required to overcome the pre-stressed moment of the elastic elongate element when it is associated with the ski is on the order of 11 kgf.

Another still further object of the present invention is the provision of a linkage apparatus, as described above, wherein the elastic elongate element is integral with the boot having a front end, preferably in the form of an extension of the front end of the boot, which includes an anterior portion having a forward lower surface area adapted to be secured to the ski, and a posterior portion having a rearward lower surface area integral with the boot, preferably wherein the forward lower surface area and the rearward lower surface area slope with respect to each other to meet at an intersection, and preferably the forward lower surface area slants downwardly away from the front end of the boot, and the intersection defines a flexion zone of the elastic elongate element.

Another yet still further object of the present invention is the provision of a ski boot including an upper portion for receiving a foot having a front end and a sole, and an elastic elongate element extending from the front end of the boot adapted to connect the ski boot to a ski; the elastic elongate element includes a forward lower surface area and a rearward surface area which slope with respect to each other to meet at an intersection below a flexion zone of the elastic elongate element, preferably wherein the rearward lower surface area is planar with the sole and the forward lower surface area slants downwardly away from the rearward lower surface.

BRIEF DESCRIPTION OF DRAWINGS

Reference will now be made to the annexed drawings given by way of non-limiting example only in which.

DESCRIPTION OF PREFERRED EMBODIMENTS

The present invention is directed to a linkage apparatus including a flexible generally elongate, elastic element adapted to be mounted to a ski and attached to a boot for interconnecting the ski and the boot in a manner which overcomes the previously discussed disadvantages associated with prior art binding systems. To accomplish this, linkage apparatus has been developed wherein the flexion blade of the linkage apparatus experiences substantially no, and in any event imperceptible, deformation manifested by virtually no lifting of the free posterior portion of the blade with respect to the ski, base plate or other support element in the absence of external force being applied to bend the blade.

In accordance with to the present invention, the respective longitudinal associated surface areas of the lower surface of the flexion blade of the linkage apparatus and of the upper surface of the ski, base plate or support element, before mounting of the flexion blade on the ski, are substantially noncomplementary. The unique, combination of noncomplementary profiles of the lower surface of the flexion blade with respect to the upper surface of the ski, base plate or support element are such that the assembly of the flexion blade on the ski causes a pre-stressed moment in the flexion zone of the flexion blade which counteracts the tendency of the posterior portion of the flexion blade to rise or be lifted off the upper surface of the ski.

According to a particular embodiment of the invention, before assembly, the longitudinal surface configuration of the lower surface of the flexion blade is generally concave, and preferably V-shaped In another embodiment of the present invention, the upper surface of the base plate is generally concave, and may also be V-shaped.

Figure 1:
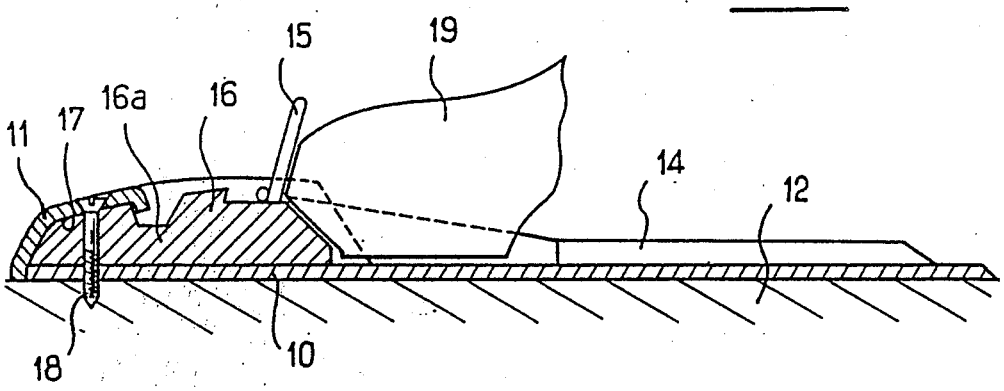
FIG. 1 is a side view of a flexion blade linking apparatus of the prior art.

FIG. 1 schematically and partially illustrates a side view in partial cross section of a prior art apparatus for linking a cross country ski with the front of a cross country ski boot. The prior art apparatus typically includes a base plate 10 attached to the upper surface 12 of the ski. The base plate 10 is provided with a longitudinal guide rail 14 on its upper surface which is conventional and adapted to firmly seat the boot on the ski to enhance guidance of the ski by the foot when the sole of the boot is placed flat against the ski.

As shown more clearly in the left of FIG. 1, the anterior region of the base plate is provided with a horizontal surface adapted to receive a blade 16, referred to herein as a flexion blade. This blade, of appropriate elasticity, is adapted to form the junction between the ski and the front of boot 19. To this end, the anterior portion of the flexion blade is pressed firmly against the horizontal surface of the plate 10. For this purpose, a maintenance cap 11, adapted to receive the front end of the flexion blade, is attached to the ski. Thus, maintenance cap 11 houses the front end of the flexion blade 10 in a cavity or chamber 17 formed between the base plate 10 and the maintenance cap 11. The rigid binding together of the assembly of cap 11, anterior portion of blade 16 and plate 10 is assured by a screw 18 which passes through the previously mentioned elements into the ski. This assembly nevertheless permits blade 16 to remain free over its entire posterior portion.

In one embodiment, the end of boot or shoe 19 is adapted to be fixed to the rear end of the flexion blade 16 by means of a conventional attachment mechanism, for example of the binding ring type, which includes a pivoting lever for insertion of the boot and support plate, which are conventional and need not be further described at this point. The drawings show only the base plate or metallic insert 15 of this mechanism. Further details of this apparatus are discussed in French Patent No. 2 447 731, and its corresponding U.S. Pat. No. 4,562,653, commonly owned with the present application, which is explicitly incorporated herein by reference, particularly with respect to the details of such a mechanism.

In the course of use, the movements imparted by the skier involve lifting the rear portion of the boot 19 with respect to ski 12 in a longitudinal vertical plane, in substantially the same manner as natural walking movements flex the sole of a shoe. In this regard, the sole of the boot flexes in the area of the ball of the foot and the portion of the sole toward the rear of the boot rises vertically while the portion of the sole in front of the ball of the foot remains in contact with the surface of the ski.

As shown in FIG. 1, blade 16 of the prior art has a region of reduced thickness 16*a* with respect to the thickness of the anterior portion of the blade and the posterior portion of the blade. The narrow region of the blade, i.e., the flexion zone is provided in the area of the blade which is intended to flex to allow for the previously described walking or skating movement when the boot is attached to the ski during cross country skiing. Thus, blade 16 deforms elastically, as illustrated in FIG. 2, around an axis situated in the pivot region of reduced thickness 16*a* of the blade, which defines a preferred flexion zone, between a horizontal position A and a maximum inclination position B.

As previously mentioned, after a certain amount of use and as a result of fatigue of the material making up the blade, blade 16 exhibits a certain permanent deformation in its pivot region or flexion zone such that the posterior portion of the blade tends to rise off the surface of the ski and forms a residual angle alpha with respect to the upper surface of base plate 10, shown as position C, in the absence of pressure being applied by the boot. The angle of deformation, i.e., alpha, can reach 15–20°degrees. It has been observed that after the initial fatigue, the angle of deformation does not increase but remains substantially within this range for the remainder of the useful life of the linkage apparatus such that the angle of permanent deformation appears to be maintained at a substantially constant value with time.

The preferred embodiments of the invention will now be described with reference to FIGS. 3*a*, 3*b*; 4*a*, 4*b*; and 5.

Figure 2:
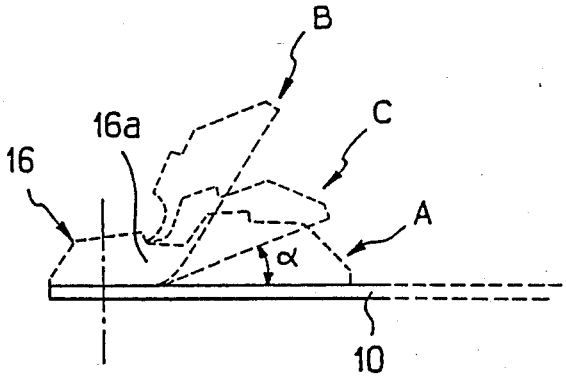
FIG. 2 is a schematic side view useful for illustrating the behavior of the linkage apparatus of FIG. 1.

In these Figures, identical or analogous elements to those of FIGS. 1 and 2 are designated by the same reference numerals. Furthermore, only the region of the ski 12, on which the base plate 10 of the linkage apparatus is attached, is shown in the figure. Although the figures illustrate the linkage apparatus of the present invention mounted to an intermediate base plate 10 attached to ski 12, it should be pointed out that the linkage apparatus of the present invention functions equally well when the base plate 10 is omitted and the linkage apparatus is mounted directly to the upper surface of the ski, and the linkage apparatus are appropriately adapted to function as such. Thus, either the ski or the base plate can provide an upper contact surface to which the elongate element, or blade, of the linkage apparatus is attached.

Figure 3A:
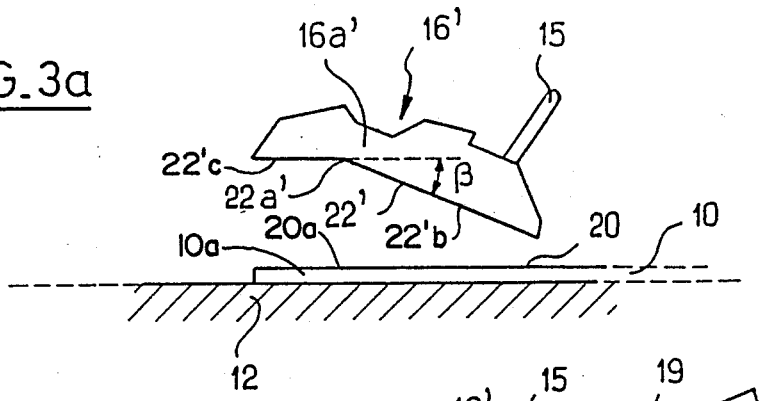
FIGS. 3*a* and 3*b* are side views of a first embodiment of the inventive apparatus, respectively, before and after assembly.

With the foregoing in mind, reference is made to FIG. 3*a*, wherein base plate 10 is shown as being attached to ski 12 in a conventional manner. In particular, the anterior region 10*a* of the base plate 10 has a horizontal surface 20*a* on which the flexion blade 16' is positioned. As shown in FIG. 3*a*, flexion blade 16' is constructed in a manner so that the lower surface 22' of the blade lies in at least one plane which is not parallel with the plane through which the horizontal longitudinal axis of the flexion blade passes in the absence of external force applied to the blade. In this regard, the lower surface of the blade is generally concave, and preferably V-shaped with the arms of the "V" forming an obtuse angle with respect to each other. The lower surface of the blade angled in the previously described manner allows the blade to assume the longitudinal profile or configuration, such as is illustrated in FIG. 3*a*, when the blade is at rest. More precisely, it will be observed that the rearward lower surface area 22'*b* of the posterior portion of the blade, shown towards the right in the Figures, is generally inclined downwardly towards the ski by an angle beta on the order of 5°–45°, preferably of 20°, with respect to the forward lower surface area 22'*c* of the anterior portion of the blade, which is intended to be fixed to the ski. As shown, the lower surface 22' of the flexion blade has a profile in the form of an inverted "V" with an obtuse apex angle 22*a'* provided in the region of reduced thickness 16a', or flexion zone, of the blade.

Figure 3B:
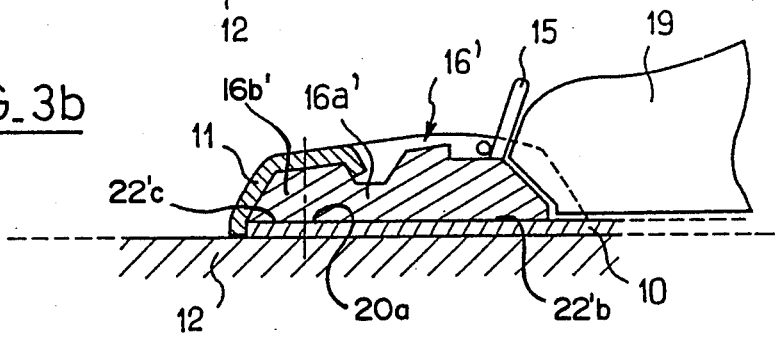

When the flexion blade 16' is positioned and fixed by its anterior portion 16b', in an otherwise conventional fashion, on the associated anterior upper surface area 20a of upper surface 20 of base plate 10, as shown in FIG. 3b, the blade 16' is deformed elastically by the forces exerted thereon to cause the forward lower surface area 22'c and rearward lower surface area 22'b of the lower surface 22 of the blade to lie in substantially the same plane essentially parallel to the upper surface 20 of base plate 10 or the ski. Thus, the lower surface 22 of the blade assumes a horizontal position against the associated upper surface 20 of the base plate.

The angular configuration of the lower surface areas of the anterior and posterior portions of the blade causes the creation of a return or pre-stressed moment in the flexion zone of the blade which tends to force the blade into its original shape. Consequently, the posterior portion of the blade is urged towards the base plate when the anterior portion of the blade is associated with the base plate in a manner which firmly presses the lower surface area of the anterior portion of the blade against the base plate.

The behavior of the linkage apparatus of the present invention is as follows. During skiing, the repeated flections of the blade cause the material of the flexion blade to fatigue, as described above. The fatigue of the blade tends to cause a permanent angular deformation of the flexion blade. The pre-stressed moment created in the blade according to the present invention as described above, however, acts in the opposite direction of this tendency of deformation thereby minimizing it. In other words the permanent deformation due to fatigue of the material of the blade is manifest when the blade is in a relaxed condition, i.e., the position which the blade occupies when no force is exerted against it which would cause the blade to bend. By forming the blade to have the longitudinal profile as shown in FIG. 3a wherein the posterior portion of the blade is angularly displaced downwardly, the tendency of the posterior portion to lift off the ski after fatigue is counterbalanced. Thus, the initial pre-stressed moment imparted to a flexion blade having a configuration in accordance with the present invention during assembly makes it possible to substantially attenuate the tendency of the the posterior portion of the blade to rise from the upper surface of the ski due to fatigue of the material. Accordingly, it is possible to prevent lift-off of the posterior portion of the flexion blade from the upper surface of the ski so that essentially no gap or space will exist between the blade and the ski during those times when no external force is applied which would otherwise cause the blade to bend. Thus, one of the main disadvantages of flexion blades of prior art devices is effectively eliminated.

Figure 4A:
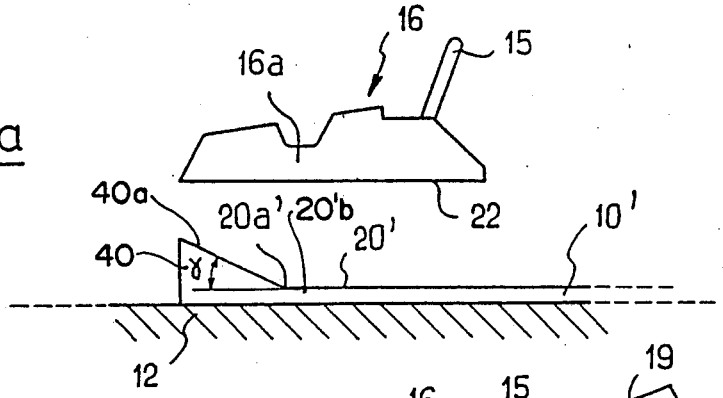
FIGS. 4*a* and 4*b* are side views of a second embodiment of the inventive apparatus, respectively, before and after assembly.
Figure 4B:
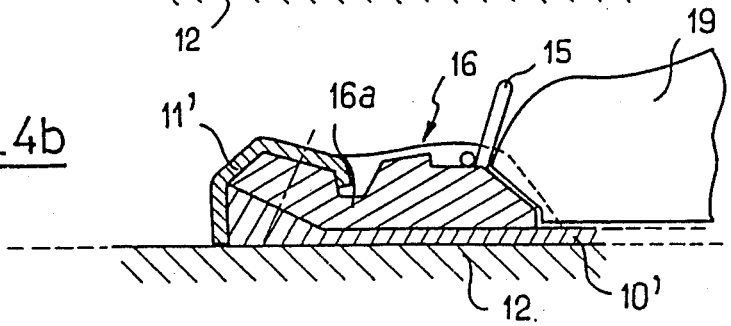

In FIGS. 4a and 4b a second embodiment to the invention is shown. In this embodiment, however, the flexion blade 16 is formed in a conventional manner, i.e., its lower surface 22 is substantially planar. In contrast, the upper surface 20' of the base plate 10' in the anterior region for receiving the anterior portion of blade 16 is provided with a protuberance, preferably in the form of a wedge 40. The anterior upper surface area 40a of the wedge-shaped protuberance 40 inclines downwardly from the front end of the wedge in a rearward direction to meet with the posterior upper surface area 20'b of plate 10' so as to impart a generally concave configuration to the upper surface 20' of the base plate or support element to which blade 16 is mounted. The concave upper surface of the support element is preferably V-shaped having an obtuse apex angle. Thus, an area of intersection or bend 20a' is provided in the region of the base plate which will correspond, after assembly, to the preferred flexion region 16a of the blade. The anterior upper surface area 40a of the wedge-shaped anterior region of the base plate is inclined upwardly by an angle gamma on the order of 5°–45°, preferably 20°, with respect to a horizontal posterior region of the base plate.

In a manner similar to the embodiment of FIGS. 3a and 3b, the act of pressing the anterior portion of the flexion blade 16 in place against protuberance 40 causes an elastic deformation of an angle gamma in the narrow region 16a of the blade which causes the posterior portion of the blade, shown towards in the right in the figures, to press against the associated region of posterior upper surface area 20'b, thus creating a similar pre-stressed moment in the flexion blade. Although in the embodiment shown in FIGS. 4a and 4b, the blade is angled in a direction opposite to the angle of the blade shown in FIGS. 3a and 3b, the pre-stressed moment loaded in the blade has substantially the same effects as those explained above in the description of the apparatus of the first embodiment shown in FIGS. 3a and 3b. In this embodiment, however, the pre-stressed moment is caused by the anterior upper surface area 40a of the protuberance which bends the anterior portion of the blade upwardly away from horizontal plane in which the posterior region of the base plate is located. This has the effect of urging the nonstressed position of the posterior portion of the blade angularly downwardly with respect to the position which it occupies after assembly to seek its natural configuration. The previously discussed disadvantages of prior art devices are here again substantially attenuated by the linkage apparatus of the present invention.

Figure 5:
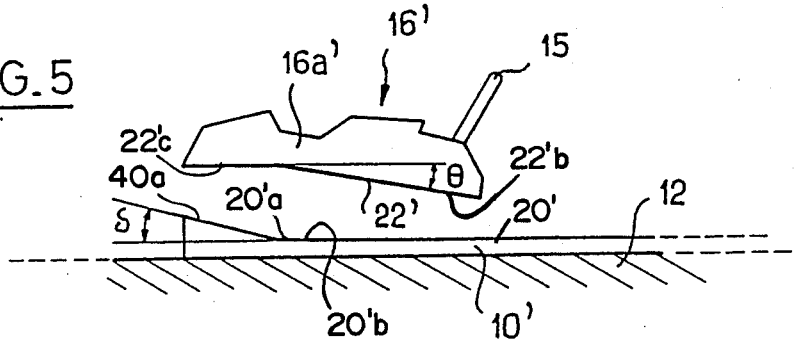
FIG. 5 is a side view of a third embodiment of the apparatus of the invention, before assembly.

A third embodiment, whose configuration is intermediate between that of the previously discussed first and second embodiments, is illustrated in FIG. 5. More specifically, the anterior upper surface area 40a of the anterior region of base plate 10' inclines by an angle delta with respect to the posterior upper surface area 20'b of a substantially planar posterior region 20'. Similarly, the lower surface 22' of the flexion blade 16 has a generally bent longitudinal profile such that the lower surface area 22'b of the posterior portion of the blade is generally inclined downwardly by an angle theta with respect to the forward lower surface area 22'c of the anterior portion of the blade. In this example, the values of delta and theta are selected such that their sum is between 5° and 45°, and preferably equal to 20°. In the embodiment illustrated, delta is equal to theta which is equal to 10°. Here again, it will be understood that the assembly of the blade 16' on base plate 10 consequently creates a pre-stressed moment in the blade due to the forced angular deformation of the posterior region of the blade by an angle equal to the sum of the angles delta and theta. This pre-stressed moment will have the same effects as discussed with respect to the two first embodiments, i.e., to substantially reduce and even eliminate the upward displacement of the posterior portion of the blade from the associated region of the base plate, after permanent deformation due to fatigue of the material making up the blade occurs. In the previously discussed embodiments of the present invention, the anterior and posterior portions and regions, respectively, of the blade and base plate have been separated by an obtuse angle.

Figure 6:
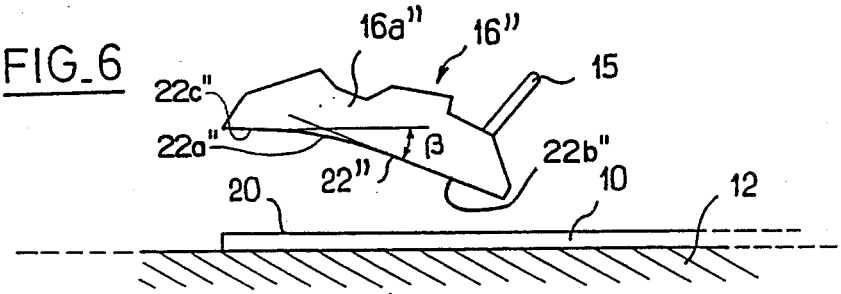
FIG. 6 is a side view of a fourth embodiment of the inventive apparatus, before assembly.

Turning now to FIG. 6, a linkage apparatus in accordance with the present invention is shown which is generally similar in certain respects to that of FIG. 3. In this regard, the upper surface 20 of the base plate 10 is planar. However, the lower surface 22'' of the flexion blade 16'' has a generally rounded section 22a'' in the region of reduced thickness 16a'' of the blade. In effect the obtuse angle at the apex of the V-shaped profile of FIG. 3a has been substantially blunted in this embodiment wherein the lower surface of the blade has a curved, preferably concave configuration.

The angle beta at the intersection of the planes of the forward and rearward lower surface areas (22c'' and 22b'') of the lower surface 22'' of the flexion blade is here again between 5° and 45°, and preferably on the order of 20°. It will be understood that the general effect of the use of such a flexion blade will be essentially the same as that which has been described with reference to FIGS. 3a and 3b. In this embodiment, however, the progressiveness of the angle between the forward and rearward lower surface areas due to the rounded section at their intersection makes it possible to redistribute the stresses which consequently are substantially less concentrated at the intermediate flexion zone 16a'' of the blade.

Figure 7:
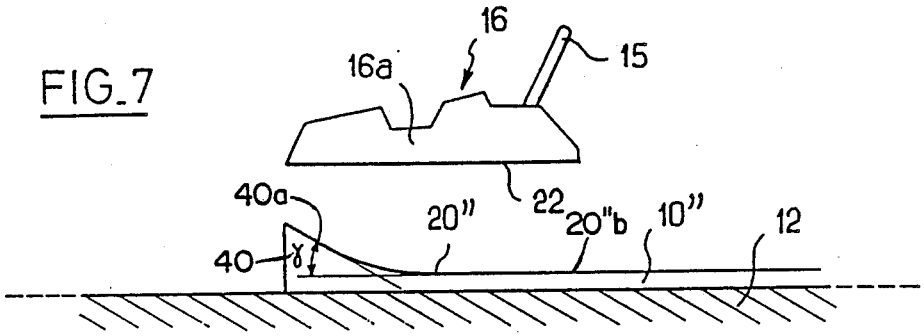
FIG. 7 is a side view of a fifth embodiment of the inventive apparatus, before assembly.

FIG. 7 illustrates an embodiment of the linkage apparatus of the invention which is generally similar to that of FIG. 4. In this embodiment, however, the profile of the upper surface 20'' of base plate 10'' is generally rounded, with the obtuse angle of the base of the "V" of the embodiment shown in FIG. 4 having been substantially blunted in a manner similar to that described above with respect to the differences between the embodiments shown in FIGS. 3a and 3b, and FIG. 6. Thus, the ramp formed by the anterior upper surface area 40a of the generally wedge-shaped protuberance or anterior region 40 slopes upwardly from a curved section located between the planar upper surface area 20''b of the posterior region of the base plate and the anterior upper surface area 40a of the anterior region of the base plate. As in the embodiment shown in FIG. 4, the flexion blade 16 in the embodiment shown in FIG. 7 assumes its conventional form, i.e., its lower surface 22 is planar, before assembly. The advantages obtained as a result of curving a section of the upper surface of the base plate in the vicinity of the region of reduced thickness of the blade are substantially the same as in the embodiment of FIG. 6 wherein the lower surface area below the region of reduced thickness of the blade is curved and the upper surface of the base plate is substantially planar and horizontal.

Along the same idea, one can modify the linkage apparatus of FIG. 5 such that the respective profiles of the upper surface 20a' of the base plate 10' and of the lower surface 22' of the flexion blade 16' are substantially rounded, in contrast to being sharply V-shaped, to have the previously mentioned angular values.

In general, the advantages and characteristics of the present invention will take effect as soon as one provides the lower surface of the flexion blade and/or the upper surface of the base plate with a generally hollow or concave configuration.

Figure 8A:
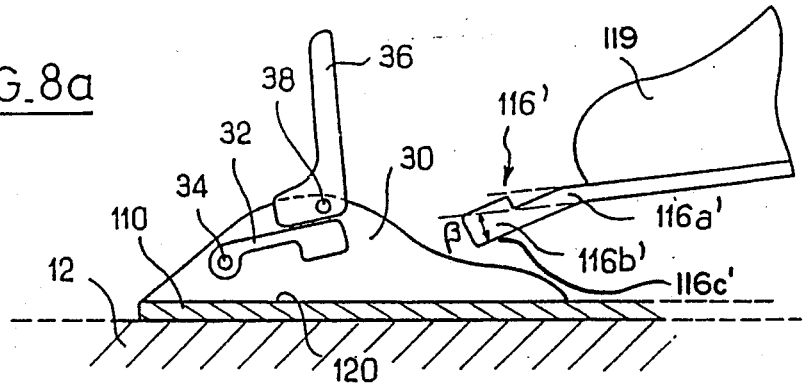
FIGS. 8*a* and 8*b* are side views of a sixth embodiment of the inventive apparatus, respectively, before and after insertion of the boot.
Figure 8B:
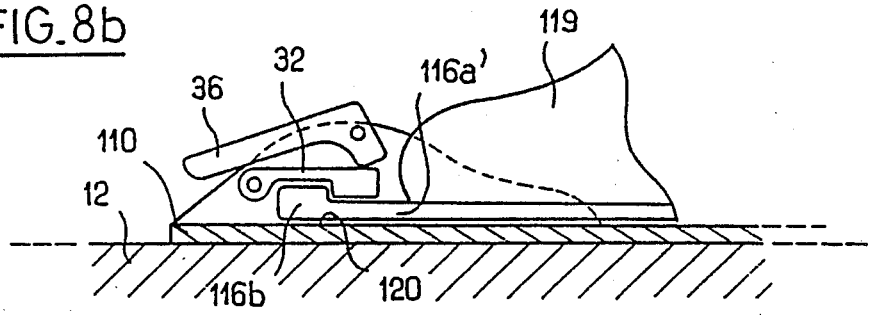

FIGS. 8a and 8b show a sixth embodiment of the invention wherein the linkage apparatus is shown respectively, before and after attachment of the boot 119 to the ski by means of a flexion blade 116''. Although flexion blade 116' is shown as being integral with the sole of boot 119, the invention further described herein with respect to this embodiment may also be used in the instance wherein the boot is attached to the flexion blade by conventional means for attachment, such as the one previously mentioned herein. This embodiment, however, will be described with respect to a flexion blade which is integral with the end of the boot. The linkage apparatus of this embodiment includes a base plate 110 mounted on the upper surface of a ski 120. A mechanism for receiving the flexion blade 116' of the boot is mounted on a support 30 The mechanism is somewhat conventional in that it includes a hook 32 which pivots around an axis 34, and a lever 36 which pivots around an axis 38. Axes 34 and 38 are transverse to the longitudinal axis of the ski. The end of the boot 119 includes a projection in the form of a flexion blade 116' as a forward extension of the sole whose free end is constituted by an attached or integral protuberance or region of increased thickness 116b' extending upwardly from the top or upper surface of blade 116'. Thus, there exists a region of reduced thickness 116a' located between the region of increased thickness 116b' and the toe of boot 119 defining the flexion region of the blade. The upper surface 120 of the base plate 110 is planar and horizontal in the region of the mechanism for receiving the flexion blade of the boot. As shown, the anterior portion of the flexion blade 116' is bent downwardly at 116a' by an angle beta. Accordingly, when the mechanism for receiving the flexion blade of the boot is utilized to attach the end of the boot 119 to the ski 12, as illustrated in FIG. 8b, the anterior portion 116b' of the flexion blade 116' is pressed against the upper surface 120 of the base plate 110 by an appropriate pivoting of lever 36 which in turn biases the hook 32 to secure the anterior portion or region of increased thickness 116b' of the blade. As shown, hook 32 extends generally longitudinally from pivot 34 rearwardly towards the boot. The hook includes a generally elongate narrow intermediate portion and an end-portion having increased thickness with respect to the narrow intermediate portion extending downwardly towards the upper surface 120 of base plate 110 for firmly securing the anterior portion of increased thickness 116b' of the flexion blade 116' within the narrow intermediate portion of the hook.

This action of insertion of the flexion blade of the boot is similar in effect to the assembly of the flexion blade in the preceding embodiments in creating a prestressed moment in the flexion blade. As previously explained in detail above, this causes an off-setting of the angular position of the flexion blade, to counteract the angle of permanent deformation, due to the fatigue of the material constituting the flexion blade so as to attenuate the bending of the blade after this fatigue occurs.

Figure 9A:
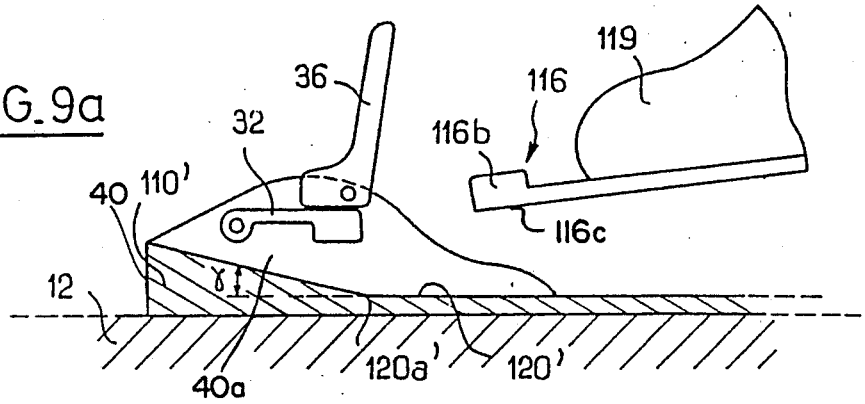
FIGS. 9*a* and 9*b* are side views of a seventh embodiment of the invention, respectively, before and after insertion of the boot.
Figure 9B:
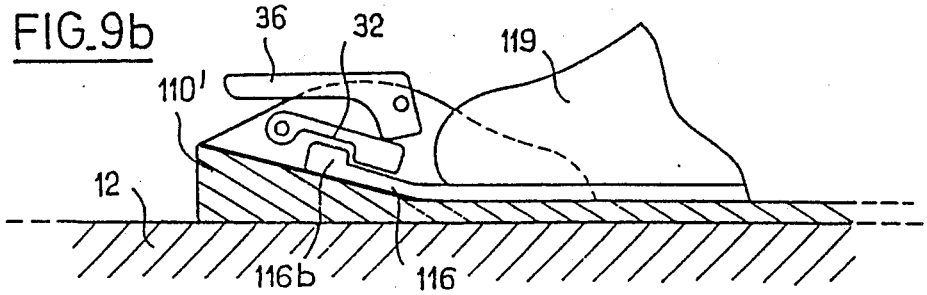

FIGS. 9a and 9b illustrate a linkage apparatus of the same general type as shown in FIGS. 8a and 8b. In these figures, identical or similar elements or parts are designated by the same reference numerals. As shown, the flexion blade 116 which extends from the front of the sole of the boot 119 in this embodiment is generally planar and coextensive with the sole of the boot. The upper surface 120' of the base plate 110' has an angled section 120a' in the region situated immediatelY to the rear of the immobilization position of the mechanism for receiving the anterior end of the flexion blade of the boot. More precisely, the anterior upper surface area 40*a* of the anterior portion of upper surface 120' is inclined generally upwardly, by an angle gamma of preferably between 5° and 45°, and more preferably equal to approximately 20°.

When the anterior portion **116*b* of flexion blade is positioned and immobilized by hook 32 of the mechanism for receiving the boot in a manner similar to that previously discussed with respect to FIGS. 8*a* and 8*b*, the angular deformation of the flexion blade in the angled section 120*a'* of the base plate 110'** causes the blade, which assumes a corresponding elastic deformation, to have a pre-stressed moment with the attendant effects consistent with those previously discussed in detail herein with respect to the other embodiments of the present invention.

Of course, even though it has not been shown in the drawings, it is also envisioned that any intermediate embodiment, in which either the flexion blade and/or the associated reception surface of the base plate are provided with an angled surface, could be used, in a manner consistent with the embodiment shown in and discussed with respect to FIG. 5.

Related to this, although FIGS. **8*a* and 9*a* illustrate a flexion blade having an anterior lower surface areas 116*c* (FIG. 8*a*) and a base plate having a wedge-shaped anterior region 40 with an anterior upper surface area 40*a* (FIG. 9*a*) which are offset at acute angles with respect to the horizontal plane in which the longitudinal axis of the ski is disposed, these angles may be blunted, so that the intersection of the surface areas of the flexion blade and/or of the base plate assume a more rounded configuration, in a manner consistent with the embodiments shown in FIGS. 6 and 7**, respectively, and previously discussed in detail herein.

Moreover, it should be understood that the present invention is in no way limited to the specific embodiments described herein. In particular, one can design the flexion blade and/or the associated reception surface of the base plate with any appropriate profile such as is obtained during assembly or during insertion of the boot so as to result with an elastic deformation of the preferred flexion zone of the blade to create a pre-stressed moment opposing the permanent deformation which the blade tends to assume due to material fatigue after a certain amount of use.

Furthermore, although the description herein often refers to a linkage apparatus for a cross-country ski in which a base plate of the apparatus includes a surface which receives the flexion blade substantially over its entire length, the invention applies equally well to apparatus in which the flexion blade is at least partially in contact directly with the ski in which case the lower surface of the flexion blade is designed and adapted in an appropriate fashion to fit flush against the upper surfaces of the ski and its associated support plate.

Finally, it may be noted that one can select for the flexion blade any elastically deformable material which is suitable for flexing in the required manner, such as the material commercially known as "HYTREL".

Although the invention has been described with reference to a particular means, materials and embodiments, from the foregoing description, one skilled in the art can easily ascertain the essential characteristics of the present invention, and without departing from the spirit and scope thereof, may make changes and modifications of the invention to adapt it to various usages and conditions.

What is claimed is:

1. A linkage apparatus for cross-country skis comprising:

an elastic elongate element for associating the upper side of a ski with a boot to allow for a pivoting movement of the boot around a substantially horizontal axis which is transverse to said ski, having a pre-stressed moment when said elastic elongate element is associated with said ski, the tendency of said elastic elongate element to lift off said ski in the absence of force being applied to said elastic elongate element being counteracted by said pre-stressed moment, wherein said elastic elongate element includes:

(a) an anterior portion having a front end and a forward lower surface area adapted to be connected to an upper contact surface on said ski; and (b) a posterior portion having a rear end adapted to be attached to said boot and a rearward lower surface area adapted to contact said upper contact surface, said forward lower surface area extending rearwardly from said front end, and said rearward lower surface area extending forwardly from said rear end so as to meet and form a lower surface of said elastic elongate element, wherein said elastic elongate element has an upper surface and predetermined thickness between said upper surface and said lower surface, wherein said elastic elongate element is provided with a flexion zone intermediate said front end and said rear end of said elastic elongate element, and wherein said forward lower surface area and said rearward lower surface area slope with respect to each other to meet at an intersection adjacent and below said flexion.

2. The linkage apparatus in accordance with claim 1, wherein said slope is towards said upper surface so that said intersection defines a region of reduced thickness with said upper surface.

3. The linkage apparatus in accordance with claim 2, wherein said intersection is generally V-shaped.

4. The linkage apparatus in accordance with claim 3, wherein at least one of said forward lower surface area and said rearward lower surface area is planar.

5. The linkage apparatus in accordance with claim 2, wherein said intersection includes a curved section.

6. The linkage apparatus in accordance with claim 5, wherein said lower surface of said elastic member is generally concave.

7. The linkage apparatus in accordance with claim 6, wherein at least one of said forward lower surface area and said rearward lower surface area is planar.

8. The linkage apparatus in accordance with claim 2, wherein said upper surface has a transverse groove above said region of reduced thickness.

9. The linkage apparatus in accordance with claim 8, wherein said elongate elastic element is in the form of a blade.

10. A linkage apparatus for cross-country skis comprising:

an elastic elongate element for associating the upper side of a ski with a boot to allow for a pivoting movement of the boot around a substantially horizontal axis which is transverse to said ski, having a pre-stressed moment when said elastic elongate is associated with said ski, the tendency of said elastic elongate element of lift off said ski in the absence of force being applied to said elastic elongate element being counteracted by said prestressed moment, wherein said elastic elongate element includes:

(a) an interior portion having a front end and a forward lower surface adapted to be connected to an upper contact surface on said ski;

(b) a posterior portion having a rear end adapted to be attached to said boot and rearward lower surface area adapted to contact said upper contact surface, said forward lower surface area extending rearwardly from said front end, and said rearward lower surface area extending forwardly from said rear end so as to meet and form a lower surface of said elastic elongate element;

(c) means for securing said anterior portion of said elastic elongate element in position on an upper surface associated with a ski, said means for securing being attached to said ski; and (d) a base plate including said upper side and a bottom side adapted to be attached to said ski, wherein said lower surface of said elastic elongate element has a longitudinal profile and said upper side of said base plate has a longitudinal profile which are non-complementary.

11. The linkage apparatus in accordance with claim 10, wherein said base plate includes:

(a) an anterior region having a front end and an anterior upper surface area connected to said forward lower surface area of said elastic elongate element, and (b) a posterior region having a rear end and a posterior upper surface area adapted to contact said rearward lower surface area of said elastic elongate element, said anterior upper surface area extending rearwardly from said front end and said posterior upper surface area extending forwardly from said rear end so as to meet and form said upper side of said base plate.

12. The linkage apparatus in accordance with claim 11, wherein said anterior region is generally wedge-shaped and said anterior upper surface area slopes downwardly from said front end to meet said posterior upper surface area at an intersection.

13. The linkage apparatus in accordance with claim 12, wherein said intersection is generally V-shaped.

14. The linkage apparatus in accordance with claim 13, wherein at least one of said anterior upper surface area and said posterior upper surface area is planar.

15. The linkage apparatus in accordance with claim 12, wherein said intersection includes a curved section.

16. The linkage apparatus in accordance with claim 15, wherein at least one of said anterior upper surface area and said posterior upper surface area is planar.

17. The linkage apparatus in accordance with claim 11, wherein said forward lower surface area and said rearward lower surface area meet at a predetermined angle of intersection prior to said elastic elongate element being secured in position on said upper side associated with said ski.

18. The linkage apparatus in accordance with claim 17, wherein said angle of intersection subsequent to said elastic elongate element being secured in position differs from said predetermined angle by an angle of deformation within the range of 5° and 45°.

19. The linkage apparatus in accordance with claim 18, wherein said angle of deformation is about 20°.

20. The linkage apparatus in accordance with claim 10, wherein the force required to overcome said prestressed moment in about 11 k.g.f.

21. The linkage apparatus in accordance with claim 18, wherein the force required to overcome said prestressed moment is about 11 k.g.f.

22. A linkage apparatus for cross-country skis comprising:

an elastic elongate element for associating the upper side of a ski with a boot to allow for a pivoting movement of said boot around an axis which is transverse to the ski by flexing of said elongate element around said axis, said linkage apparatus comprising means for applying to said elongate element a moment prestressing said elongate element against the upper surface of the ski, wherein said elongate element further comprises a first end portion, having a lower surface, for connection to said boot and a second end portion, having a lower surface, for connection to a contact surface fixed relative to said ski, said lower surface of said first end portion and said lower surface of said second end portion meeting at an area of intersection and projecting from said area of intersection and facing in directions which intersect at an obtuse angle.

23. The linkage apparatus in accordance with claim 22, wherein said lower surface of said first end portion, said lower surface of said second end portion, and said area of intersection form a substantially V-shape.

24. The linkage apparatus in accordance with claim 22, wherein said axis is located at said area of intersection, said wherein said linkage apparatus is configured so that it can pivot only about said axis during use of said linkage apparatus.

25. A ski boot and linkage apparatus for cross country skiing comprising:

a ski boot, said ski boot having an upper portion for receiving a foot and having a front end and a sole;

an elastic elongate element for associating the upper side of a ski with said boot for permitting the heel of said boot to lift therefrom by flexing of said elastic element; and an upper support surface on said ski;

wherein said elastic elongate element and said upper support surface have configurations for deforming and creating a pre-stressed moment of said elastic elongate element when it is associated with said upper support surface for urging said elastic elongate element toward said ski, and wherein said elastic elongate element extends from said front end and adapted to connect said ski boot to said ski, said elastic elongate element further comprising a forward lower surface area and a rearward surface area which slope with respect to each other to meet at an intersection below a flexion zone of said elastic elongate element.

26. The linkage apparatus and ski boot in accordance with claim 25, wherein said rearward lower surface area is planar with said sole and said forward lower surface area slants downwardly away from said rearward lower surface.

* * * * *